United States Patent [19]

Schwartz

[11] Patent Number: 4,932,693

[45] Date of Patent: Jun. 12, 1990

[54] GATE LATCH ASSEMBLY AND HINGE

[75] Inventor: Bruce H. Schwartz, Huntingdon Valley, Pa.

[73] Assignee: Jerith Manufacturing Co., Inc., Philadelphia, Pa.

[21] Appl. No.: 283,662

[22] Filed: Dec. 13, 1988

[51] Int. Cl.[5] ..... E05B 9/02; E05C 3/14

[52] U.S. Cl. ..... 292/205; 16/72; 16/299; 292/228; 292/244; 292/337; 292/DIG. 13

[58] Field of Search ..... 292/226, 228, 244, 245, 292/205, 337, DIG. 13, DIG. 29, 126; 70/462; 16/72, 295, 299

[56] References Cited

U.S. PATENT DOCUMENTS

| | | | |
|---|---|---|---|
| 66,832 | 7/1867 | Greenside . | |
| 951,327 | 3/1910 | Meyer | 16/365 X |
| 1,112,738 | 10/1914 | Voigt | 292/205 X |
| 1,181,177 | 5/1916 | Simmons | 16/295 |
| 1,263,248 | 4/1918 | Hope | 16/365 X |
| 1,575,493 | 3/1926 | Lang | 292/205 X |
| 1,727,321 | 9/1929 | Arocha | 16/365 |
| 1,958,579 | 5/1934 | Johnson et al. | 16/149 |
| 2,537,896 | 1/1951 | Hinton et al. | 16/307 X |
| 3,095,227 | 6/1963 | Casebolt | 70/451 |
| 3,538,538 | 11/1970 | Field | 16/301 |
| 3,898,708 | 8/1975 | Gwordz | 16/301 |
| 3,907,344 | 9/1975 | Newlon et al. | 292/66 |
| 4,073,037 | 2/1978 | Curry et al. | 16/169 |
| 4,073,038 | 2/1978 | Curry et al. | 16/301 |
| 4,096,719 | 6/1978 | Tranberg | 292/337 X |
| 4,192,536 | 3/1980 | Laureano | 292/228 |
| 4,305,611 | 12/1981 | Robins | 292/238 |
| 4,315,648 | 2/1982 | Labelle | 292/150 |

FOREIGN PATENT DOCUMENTS

| | | | |
|---|---|---|---|
| 452783 | 11/1948 | Canada | 292/205 |
| 560486 | 7/1958 | Canada | 292/244 |
| 600669 | 8/1934 | Fed. Rep. of Germany | 70/448 |
| 154399 | 9/1938 | Fed. Rep. of Germany | 292/337 |
| 2458044 | 6/1976 | Fed. Rep. of Germany | 16/365 |
| 3142232 | 5/1983 | Fed. Rep. of Germany | 16/72 |
| 3602131 | 7/1987 | Fed. Rep. of Germany | 16/72 |
| 395783 | 1/1966 | Switzerland | 292/337 |
| 258172 | 9/1926 | United Kingdom | 16/365 |

*Primary Examiner*—Lloyd A. Gall

*Attorney, Agent, or Firm*—Panitch, Schwarze, Jacobs & Nadel

[57] ABSTRACT

A gate latch assembly includes a pair of cover members having a common plane of symmetry. A first cover member defines a recess receiving an adjoining lever and spacer block, each having its own plane of symmetry perpendicular to the cover plane of symmetry. The spacer block includes a pair of recesses on opposing sides of the block at one end thereof for receiving the lever on either side of the block. The remaining cover member closes the recess and defines another recess with the first cover member for receiving a portion of a gate or other swinging member on which the gate assembly is mounted. The symmetry of the assembly permits it to be used for left-handed or right-handed and inside or outside opening. A preferred hinge includes a pair of identical post leaves and a gate leaf. Each post leaf includes a knuckle and a post plate supported tangentially from the knuckle by an extenison portion. The extension portion spaces the knuckle from the post plate sufficiently to permit the post plates to be mounted to a flat surface as well as to two intersecting corner surfaces of a support. The hinge may be spring loaded.

20 Claims, 4 Drawing Sheets

GATE LATCH ASSEMBLY AND HINGE

FIELD OF THE INVENTION

The invention relates to gate latches and hinges, and, in particular, to gate latches and hinges which may be mounted in any of a variety of configurations including single and double gate configurations.

BACKGROUND OF THE INVENTION

Gate latches and hinges are mounted in any of a variety of configurations. Typical configurational choices include inside/outside mounting, single gate/double gate mounting, single handle/double handle mounting, recessed/flush mounting, etc.

It is very valuable for a gate latch and a hinge to be capable of being mounted in each of the various configurations typically encountered with minimum modification or need for substitute parts.

SUMMARY OF THE INVENTION

The invention includes a gate latch assembly comprising a lever having at least one generally elongated portion for engaging a latch keeper, a spacer block having a pair of opposing sides and a recess on each of the opposing sides for receiving the lever on either of the opposing sides of the spacer block. A cover means is provided having a recess adapted for receiving the spacer block and the adjoining lever. The cover means is further adapted for mounting the latch assembly to a gate for use with the lever on either of the opposing sides of the spacer block. Lastly, means are further provided for supporting the lever for rotation in the latch assembly.

BRIEF DESCRIPTION OF THE DRAWINGS

The foregoing Summary of the Invention, as well as the following Detailed Description of the Preferred Embodiments of the invention, will be better understood when read in conjunction with the appended drawings. It should be understood, however, that this invention is not limited to the precise arrangements or instrumentalities illustrated. In the drawings.

DETAILED DESCRIPTION OF THE PREFERRED EMBODIMENTS

Figure 1:
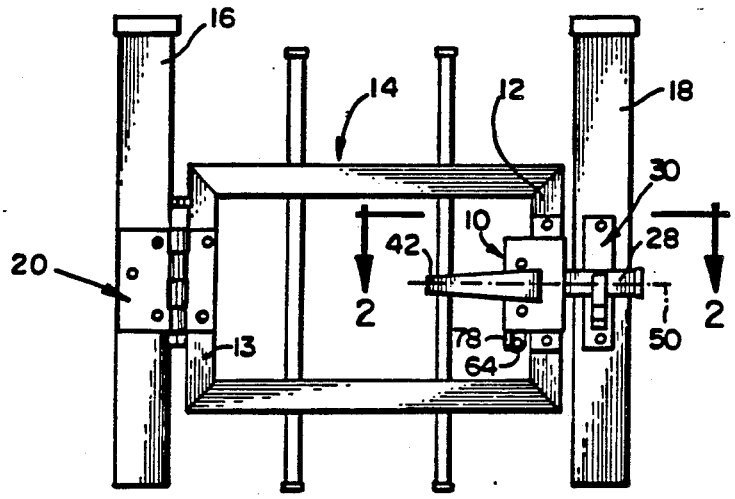
FIG. 1 is a diagrammatic front elevation view of the preferred latch assembly and hinge of the present invention mounted on a single gate recessed between two posts.

In the figures, like reference numerals are used to indicate identical elements.

Figure 2:
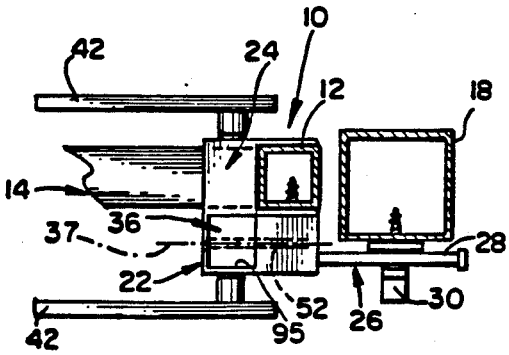
FIG. 2 is a diagrammatic top plan view of the latch assembly taken along the lines 2—2 of FIG. 1.

FIGS. 1 and 2 depict diagrammatically, a presently preferred latch assembly of the invention in one typical mounting configuration. The latch assembly, identified generally by the reference numeral 10, is mounted on a vertical member 12 of a gate, indicated generally by the reference numeral 14. The gate 14 is rotatably mounted between a pair of fixed posts 16 and 18 by at least one hinge 20 (depicted) and, preferably, two of the vertically spaced hinges 20 (the pair not being depicted for clarity), mounted to post 16 and another vertical member 13 of the gate 14. A latch keeper 30 is mounted to the other post 18 adjoining the latch assembly 10. The mounting of the latch assembly 10 and latch keeper 30 in FIG. 1 is referred to as right-front opening, the gate 14 opening towards the viewer from the right side. Viewed from the other side of FIG. 1, the configuration would also be referred to as left-rear opening. Obviously, the assembly 10 and keeper 30 could also be mounted on the left rear side of the gate 14 as viewed in FIG. 1 by a 180 degree rotational transposition of the latch assembly 10, keeper 30 and the hinge 20 about the vertical center line of the gate 14.

Figure 3:
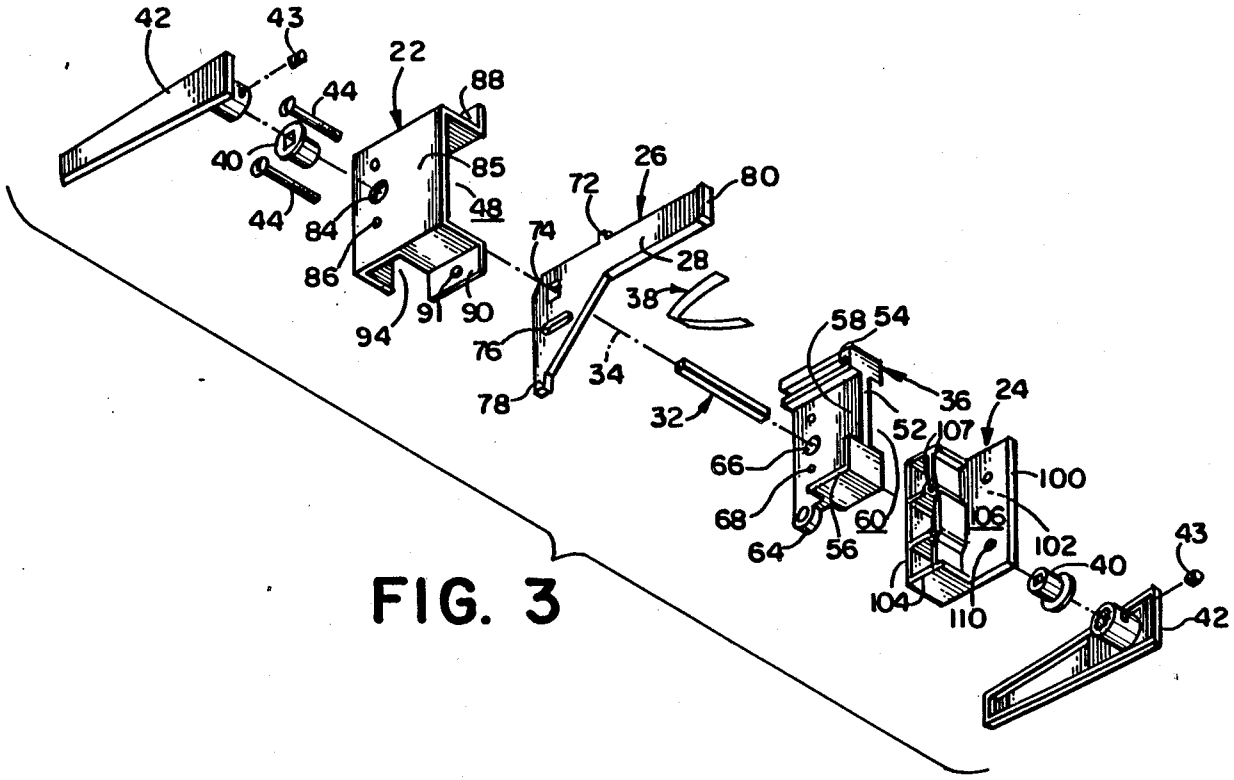
FIG. 3 is a diagrammatic exploded view of the latch assembly.

The components of the latch assembly 10 are shown in an exploded view in FIG. 3. The latch assembly 10 includes cover means, preferably in the form of a front cover member 22 and a back cover member 24. The latch assembly further includes a lever 26 having an elongated portion 28 for engaging the latch keeper 30 (see FIGS. 1 and 2). The latch assembly 10 further includes a spindle 32, preferably having a square cross-section, extending through a matching square opening 74 in the lever 26, generally transversely to the elongated portion 28 and elongated direction of that portion, for supporting the lever 26 for rotation in the latch assembly 10 about the central axis of the spindle 32, coincident with line 34. The latch assembly 10 also includes spacer means, preferably in the form of a single spacer block 36. The spacer block 36 is adapted to be positioned adjoining the lever 26 on either elongated side of the lever 26, that is, to adjoin the right side of the lever 26, as shown and viewed in FIG. 3, or the left side of the lever 26 as the lever is viewed in FIG. 3. The front cover member 22 of the depicted preferred embodiment includes a recess 48 which receives the lever 26, the spindle 32 and the spacer block 36. Preferably, the recess 48 is centrally located in the front cover member 22 and both the front cover member 22 and the recess 48 are generally symmetric with respect to a horizontal plane represented by line 50 in FIG. 1, extending in and out of that figure and bisecting both the front cover member 22 and the recess 48. This permits inversion of the front cover member 22, as will be subsequently discussed.

Preferably, the latch assembly 10 further includes biasing means in the form of a leaf spring 38 for biasing the lever 26 to the latching configuration depicted in FIG. 1 engaged with the keeper 30. Preferably, the assembly 10 further includes a pair of identical bushings 40 received on opposing axial ends of the spindle 32 and a pair of identical handles 42, which are also received on the opposing axial ends of the spindle 32 and attached thereto by conventional means such as set screws 43, for front and/or rear opening of the gate 14. Cover fasteners in the form of a pair of identical machine screws 44 are also provided for coupling the cover members 22, 24 lever 26 and spacer block 36 together.

Preferably, the spacer block 36 includes a central planar web portion identified generally at 52, an upper flanged portion identified generally at 54, and a lower flanged portion identified generally at 56. A recess 58 is defined by the web portion and the upper and lower flanged portions 52, 54, 56 on the left side of the web portion 52 of the spacer block, as viewed in FIG. 3, for receiving the lever 26 therein. A second, mirror recess 60 is defined on an opposite side (right side in FIG. 3) of the spacer block 36 by the same elements. The two opposing lateral sides of the spacer block (right side and left side in FIG. 3) are symmetric with respect to an imaginary central plane parallel with and bisecting the web portion 52 of the spacer block 36. This plane is horizontal in FIGS. 2 and 5, extending into and out of those figures, and represented by line 37 in those figures. The opposing lateral sides (right and left side in FIG. 3) of the lever 26 are likewise symmetric about an imaginary plane bisecting the lever 26. The lever plane of symmetry is parallel to the lateral sides of the lever 26 and parallel to the plane of symmetry of the spacer block 36 represented by line 37 in FIGS. 2 and 5. The recesses 58 and 60 in the spacer block 36 are configured to receive the lever 26 identically on either side of the spacer block 36 and to permit an identical degree of rotation of the lever 26 about the spindle 32 up from and down to the generally horizontal, "latching" orientation of the elongated portion 28 of the lever depicted in FIG. 1. Recesses 58 and 60 are symmetrically located on either of the two opposing lateral sides (right and left) of the spacer block 36 and towards one end, the upper end of its two opposing ends (upper and lower end) in FIG. 3.

Preferably, the spacer block 36 further includes a padlock loop 64 projecting outwardly from one end (the lower end in FIG. 3), the use of which will be subsequently explained. A larger bore 66 is provided midway between the two opposing upper and lower ends of the spacer block 36 for passing the spindle 32 through the spacer block 36. Two smaller bores 68 are spaced equal distances above and below on the larger bore 66 for permitting the fastener screws 44 to be passed through the spacer block 36.

The lever 26 further includes a stop member 72 projecting from one side (the upper side in FIG. 3) for contacting an end of the leaf spring 38 to assist in retaining and compressing the spring 38. A lower arm of the spring 38 rests on the upper side of the lever 26 while the upper arm of spring 38 is received between the pair of parallel, spaced flanges forming upper flanged portion 54 of spacer block 36. This provides positive capture of the spring 38 in the assembly 10. A square opening 74 receives the spindle 32, coupling the lever 26 to the spindle 32 for rotation. Elongated slot opening 76 through the lever 26 receives one of the fastener screws 44 and permits rotation of the lever 26 with the screw 44 extending therethrough. The lever 26 further includes a dog 78 positioned to extend through an opening 94 provided on the bottom side of the front cover 22, on one side of the padlock loop 64 of the spacer block 36, when the lever 26 is in the horizontal "latching" orientation depicted in FIG. 1. The dog 78 must be rotated across the padlock loop 64 when the lever 26 is rotated up from the "latching" orientation to unseat the lever 26 from the latch keeper 30. As is best seen in FIG. 1, both the dog 78 and padlock loop 64 extend from the lower end of the latch assembly 10 for receiving the hasp of a padlock in the padlock loop 64 to prevent rotation of the dog 78 and thus unlatching of the lever 26 from a latch keeper 30.

Referring to FIG. 3, the front cover member 22 is preferably shaped from a casting or sheet metal and has a plurality of intersecting vertical and horizontal walls defining the recess 48 which is open on two adjoining sides (front and right in FIG. 3) for receiving the lever 26, spacer block 36 and spindle 32 in an assembled form with spring 38. A larger bore 84 is centrally provided through a major vertical wall 85, midway between the upper and lower edges of that wall, for passing the spindle 32 therethrough and receiving one of the bushings 40. A pair of smaller bores 86 are provided at equal distances above and below the larger bore 84 for passing the fasteners 44 through the front cover member 22. Upper and lower flanges 88 and 90, respectively, are provided on the opposing ends of the front cover member 22. Lower flange 90 has a bore 91 therethrough for receiving a screw or other fastener for attaching the front cover member 22 with lever 26, spindle 32, spacer block 36 and spring 38 in the recess 48 to a vertical surface such as that of member 12 of the gate 14. The upper flange 88 also has a bore (not seen in the figures) symmetric to bore 91 and provided for the same purpose. The opening 94 in the lower end of the cover member 22 permits the dog 78 and padlock loop 64 to protrude downwardly from the lower end of the front cover member 22. A mirror image opening 95 (see FIG. 2) is provided in the upper side of the front cover plate 22. The bores 84 and 86, flanges 88 and 90, bore 91 and its mirror, and openings 94 and 95 are all symmetrically located with respect to a horizontal plane extending into and out of FIG. 1 and represented by line 50. Line 50 also bisects a depicted handle 42, spindle 32, the elongated portion 28 of the lever 26 and the back cover member 24 as will be subsequently described. This symmetry permits the front and back cover members 22 and 24 to be rotated about spindle axis 34 for use of the latch assembly 10 on the left-front or right-rear side of the gate 14 as viewed in FIG. 1 for left-front or right-rear opening.

The back cover member 24 is preferably provided both to cover the portion of the latch assembly 10 exposed on the back side of the front cover member recess 48 (right side as viewed in FIG. 3) and to form a recess with the spacer block 36 (and lever 26 if mounted on the rear cover side of the spacer block, right side in FIG. 3) for receiving vertical member 12 of the gate 14.

Referring to FIG. 3, the back cover member 24 has a planar portion 100 with a finished, major planar outer side 102. A network of interconnected webs 104 project outwardly from an opposing, planar inner side 106 of the planar portion 100. Bosses 107 formed at intersections of the webs 104 are bored and tapped to receive the fasteners 44. The webs 104 protrude approximately one-half inch from the inner side 102 to form an approximately one-half inch wide gap between the remainder of the planar portion 100, "forward" of the webs 104, and the facing side of the spacer block 36 for receiving an approximately one-half inch thick vertical gate member 12 therebetween. Bores 110 are provided through upper and lower ends of the planar portion 100 of the back cover member 24 to receive fasteners (not depicted) to attach the back cover member 24 to the gate member 12. A larger bore (not seen in FIG. 3) is also provided through the planar portion 100 within the webs 104 for receiving the remaining bushing 40 and passing the spindle 32 through the back cover member 24. The back cover member 24 is also symmetric with respect to the horizontal plane of symmetry represented by line 50 in FIG. 1 for inverting the back cover member 24 to mount the latch assembly 10 for left-front or right-rear opening.

The FIGS. 1 through 5 depict installation of the latch assembly 10 for a gate which is either hinged left and opens out or is hinged right and opens in. For gates which are hinged and open the opposite way, the front and back plates 22 and 24 are rotated 180 degrees about the spindle axis 34 while the lever 26, spacer block 36 and spring 38 are rotated 180 degrees about a vertical axis perpendicular to the spindle axis 34. The remaining components are rotated appropriately.

For a single gate type installation, like the walk gate depicted in FIGS. 1 through 3, where the gate is centered between a pair of vertical posts 16 and 18 wider than the width of the vertical member 12 of the gate 14, the lever 26 positioned between the front cover member 22 and the spacer block 36, as is depicted in FIGS. 2 and 3, to engage the latch keeper 30 mounted to the post 16.

Figure 4:
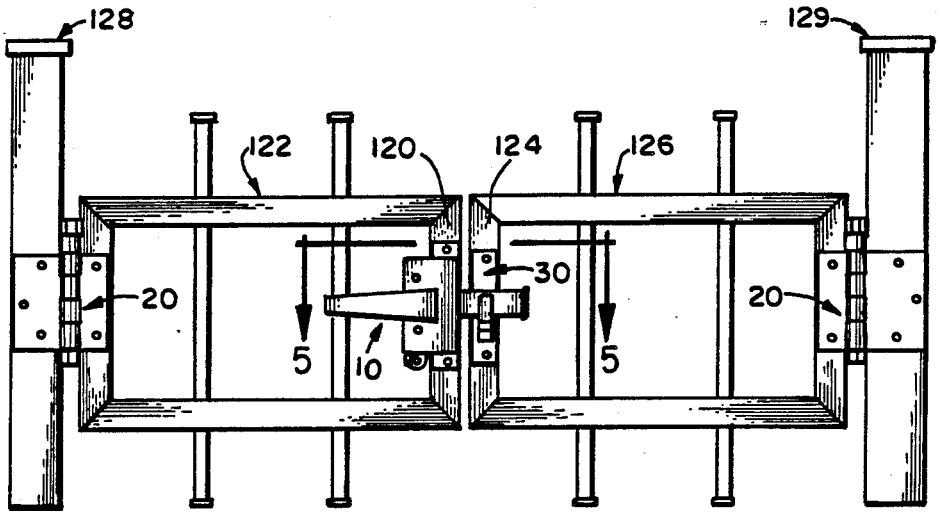
FIG. 4 is a diagrammatic front elevation view of the preferred latch assembly and pair of hinges mounted on a double gate.
Figure 5:
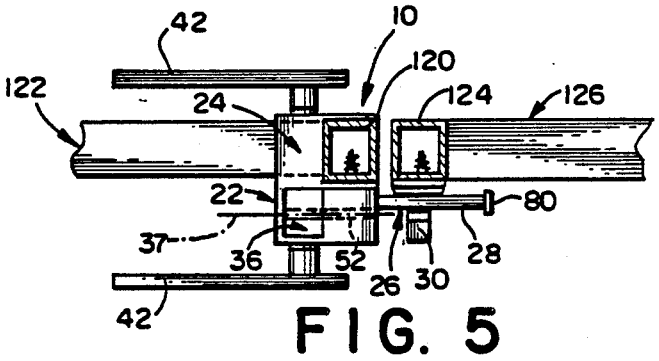
FIG. 5 is a diagrammatic top plan view taken along the lines 5—5 of FIG. 4.

If the gate 14 is mounted flush with the face of a post 16 supporting the latch keeper 30, then it is suggested that the lever 26 be positioned between the spacer block 36 and the back cover member 24. Such an installation is also typically used for double gates (i.e. drive gates) as depicted in FIGS. 4 and 5. The latch assembly lo is mounted to the vertical member 120 of a first gate 122 and the latch keeper 30 is mounted to the vertical member 124 of a second, adjoining gate 126, flush with the first gate 122. The tab 80 flaring transversely from the elongated portion 28 of the lever 26, at the remote end of that portion (see FIG. 5), prevents the lever 26 from sliding out of the latch keeper 30 when the assembly 10 and a latch keeper 30 are mounted to the pair of adjoining gates 122 and 126 in the manner indicated in FIGS. 4 and 5 and the gates are swung open. Again, at least one and, preferably, two or more of the preferred hinges 20, vertically spaced, are used to mount each gate 122 and 126 to an adjoining support column 128 and 129, respectively. The positioning of the lever 26 between the spacer block 36 and the back cover member 24, adjoining the gate support member 120, is illustrated in FIG. 5. This corresponds to the positioning of lever 26 in recess 60 on the right side of the spacer block 36 in FIG. 3.

The latch assembly 10 can be mounted to vertical members 12 and 120 having widths other than one-half inch by the use of other, suitably dimensioned back cover members 24 and, if necessary, spindles 32.

Preferably, the components are formed of noncorroding material(s) such as plastics and metal alloys, which may be painted or otherwise coated to match the finish of the gates or are otherwise finished such as by coating so as not to rust.

The elongated portion 28 of the lever 26 preferably extends at least about 2½ inches or more from the front cover 22 to allow for heat expansion and contraction of the gate openings and for minor installation variations in the recommended gate opening.

Figure 6:
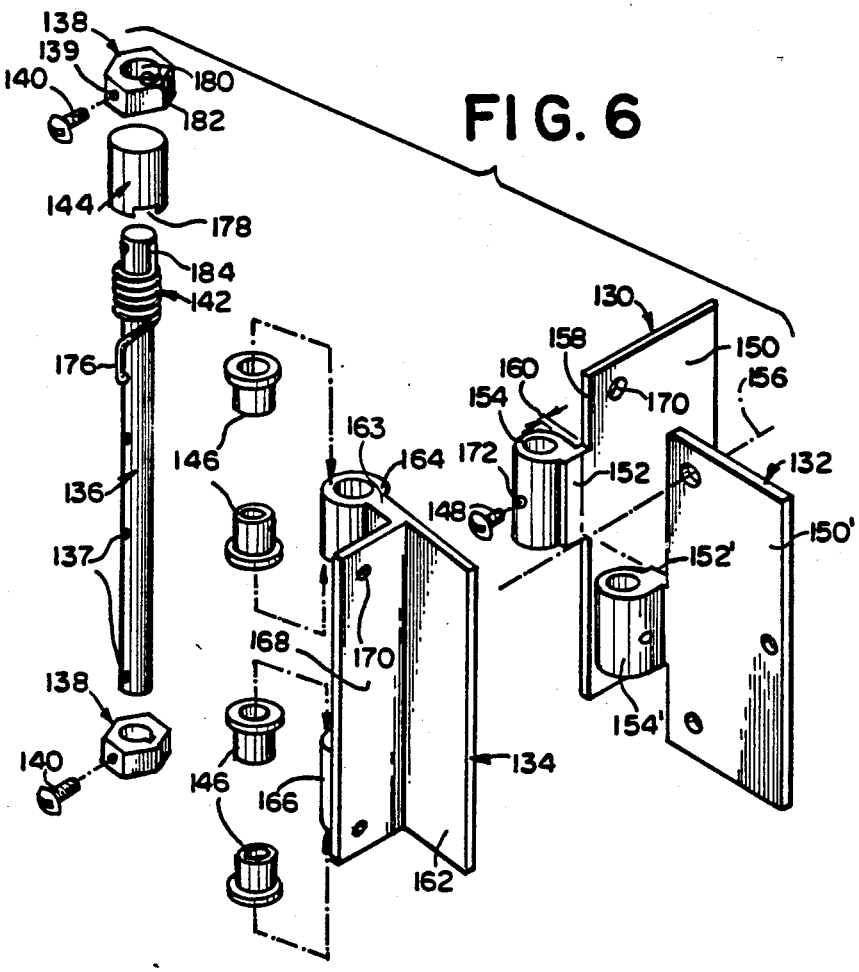
FIG. 6 is an exploded view of the hinge.

FIG. 6 depicts diagrammatically, in exploded form, the preferred spring loaded hinge 20. Hinge 20 includes first and second post leaves 130 and 132. The post leaves 130 and 132 are oriented in FIG. 6 for mounting on the intersecting planar walls of a support such as the support post 16 in FIG. 1. The hinge 20 further includes a gate leaf 134 which is mounted to and pivotally supports the gate 14, and a hinge pin 136, passing through knuckles of the three leaves 130, 132 and 134.

The hinge 20 preferably also includes a pair of identical end caps 138, which are ultimately fixedly mounted to the axial ends of the hinge pin 136 with set screws 140, a coil spring 142 for spring loading the hinge, a tubular cover 144 for covering the spring 142, four bushings 146 and an additional set screw 148.

Figure 8:
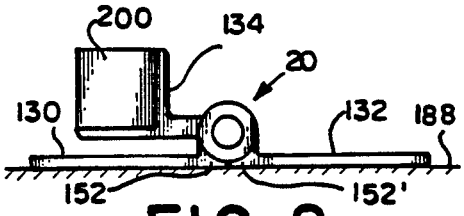
FIG. 8 is a diagrammatic top plan view of the hinge mounted to a planar support surface.
Figure 7:
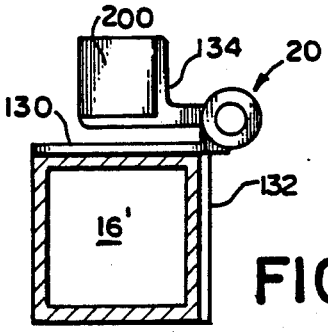
FIG. 7 is a diagrammatic top plan view of the hinge of FIG. 6 mounted to adjoining, right angle sides of a support post.

The post leaves 130 and 132 preferably are identical. Post leaf 130 includes a planar, rectangular post plate 150. A parallel planar extension 152 of the post plate 150 supports a single knuckle 154 one side of which adjoins a center line 156 of the post plate 150. The post plate 150 is supported tangentially with respect to the knuckle 154 by the extension 152. By positioning the knuckles 154 adjoining the center line 156, the knuckles of leaves 130 and 132, which are just inverted with respect to one another, adjoin, permitting them to be used with one another. At the same time the planar extension 152 supports the adjoining narrow side edge 158 of the post plate 150 radially outwardly beyond the outer circumference of the knuckle 154 to provide a radial gap 160 sufficiently great to space the narrow side edge 158 from the hidden face of the parallel planar extension 152′ of post leaf 132, adjoining that side edge 158, when the post leaves 130 and 132 are arranged at a 90 degree included angle, as is indicated in FIGS. 6 and 7. The planar extensions 152 and 152′ of the post leaves 130 and 132, respectively, further space the knuckle 154 of post leaf 130 and the knuckle 154′ of post leaf 132 sufficiently outwardly from the plane of the plates 150 and 150′ of those leaves 130, 132, respectively, when those leaves are arranged parallel to one another against a planar support surface, as is depicted in FIG. 8, to provide sufficient clearance for the rotating components of the hinge 20. The gate leaf 134 includes a major, generally rectangular support plate 162 which extends substantially radially from a pair of knuckles 164 and 166 located at opposing ends of the plate 162. The support plate 162 is spaced from the knuckles 164 and 166 by spacer portion 163 extending radially from each of the knuckles 164 and 166 to a junction of the support plate 162 and a second support plate member 168. The knuckles 164 and 166 are spaced sufficiently apart to receive therebetween the knuckles 154 and 154′ of post leaves 130 and 132, as well as the flange portions of the two bushings 146 received in the ends of the knuckles 164 and 166 facing one another. The second support plate member 168 extends substantially perpendicularly from one side of the major support plate 162 at a position spaced from the knuckles 164 and 166. Each of the planar post plates 150 and 150′ of the post leaves 130 and 132, respectively, and the major and second support plates 162 and 168, respectively, of the gate leaf 134 are provided with a plurality of bores 170 for passing screws (not depicted) or other fasteners through those planar members to attach the post plates 150 and 150′ to a support and the plates 162 and 168 to the corner of a gate, door or other device pivotally supported by the gate leaf 134.

Assembly and operation of the hinge 2 is straightforward. Bushings 146 preferably are inserted in the opposing ends of each of the knuckles 164 and 166 of the gate leaf 134. The knuckles 154 and 154′ are positioned between the knuckles 164 and 166 of the gate leaf and align generally coaxially therewith to receive the hinge pin 136. Preferably, an end cap 138 is attached to one end of the hinge pin (the lower end in FIG. 6), and a set screw 140 threadingly received in a bore 139 therein. Set SCrew 148 is threadingly received in a bore 172 of one of the post leaf knuckles 154 or 154' to fixedly couple that knuckle with the hinge pin 136. The spring 142 is positioned at the remaining axial end (upper end in FIG. 6) of the hinge pin 136. The spring 142 includes a first tag end 176 which extends generally parallel to the axis of the hinge pin 136 towards the gate leaf 134 and is inserted into a bore provided in the spacer portion 163 adjoining the junction of the plates 162 and 168, which is hidden behind plate 168 and not visible in FIG. 6, to receive that tag end 176. This prevents the first tag end 176 from deforming and slipping off the gate leaf 134 if the spring 142 is overwound. The tubular cover 144 is positioned over the spring 142 and supported on the adjoining surface of the knuckle 164, covering the spring 142 and adjoining flange of the bushing 146 in the upper end of knuckle 164. A cutout 178 is provided adjoining the tag 176 to permit the tag 176 to extend from the housing 144. The remaining end cap 138 is positioned over the remaining end (upper end in FIG. 6) of the hinge pin 136. Each of the end caps 138 includes a larger central bore 180, which receives an axial end of the pin 136, and a smaller parallel bore 182, extending along a side of the larger bore 180 forming a groove in that bore. A second tag end 184 of the spring 142 also extends substantially parallel to the axis of the hinge pin 136 and is received in the smaller bore 182. The tag end 184 is captured in the smaller bore 182 by the pin 136 received in the larger bore 180. The upper end cap 138 is thereafter rotated on the hinge pin (clockwise looking down on hinge pin 136 in FIG. 6) to position the lower tag 176 against the gate leaf plate 162 and, if desired, to further preload the spring 142. The upper end cap 138 is fixedly secured to the hinge pin 136 in the angular position providing the desired degree of preloading on the spring 142 by means of the set screw 140 threadingly received in bore 139 of the upper end cap 138. Preferably recesses or bores 137 are provided along the length of hinge pin 136 at appropriate spacings for receiving the set screws 140 in end caps 138 and the set screw 144 in either knuckle 154 and 154'. In this way, the hinge pin 136 is non-rotatably coupled with one of the post leaves 130, 132 and has one end non-rotatably coupled with one tag end 184 of the coil spring 142 through the end cap 138. The remaining tag end 176 of the coil spring 142 is free to rotate with the gate leaf 134. Rotation of the gate leaf 134 against the tag 176 (clockwise in FIG. 6 looking down on the top of the hinge pin 136) further loads the spring 142.

FIG. 8 depicts the preferred hinge 20 mounted to a planar support surface 188. The extensions 152 and 152' of the identical post leaves 130 and 132 space the remaining portions of the hinge 20 away from the surface 188 sufficiently to permit nearly a 180 degree range of rotation of the gate leaf 134 and its supported swinging member 200. If at least a 180 degree range of rotation of the gate leaf is required, the post leaves 130, 132 need to be mounted to support surfaces having an included angle of intersection less than 180 degrees, such as the sides of a post 16' like post 16 in FIG. 1, which have an included angle of intersection of approximately 90 degrees. Such a mounting is depicted diagrammatically in FIG. 7.

Preferably, the components of the hinge 20 are non-corrodible and may be made of such materials as aluminum, nylon and/or stainless steel. The leaves 130, 132 and 134 can be fabricated from extrusions. The components of the preferred hinge 20 can be assembled for either left or right hinge mounting and in or out opening. Because the hinge pin 136 is locked to one of the two post leaves, the friction generated by the movement of the gate leaf 134 falls on the bushings 146 through which the hinge pin 136 is attached to the gate leaf 134 of the hinge 20.

While a preferred embodiment latch assembly has been described and variations thereto suggested, the present invention may be embodied in other specific forms without departing from the spirit or essential attributes thereof. Accordingly, reference should be made to the appended claims, rather than to the foregoing embodiments, as indicating the scope of the invention.

I claim:

1. A gate latch assembly comprising:

a lever having at least one generally elongated portion for engaging a latch keeper;

a spacer block having a pair of opposing elongated sides and a recess on each of the opposing sides for receiving the lever on either of the opposing sides of the spacer block;

cover means having a recess adapted for receiving the spacer block and the adjoining lever, the cover means being adapted for mounting the latch assembly to a gate for use with the lever on either of the opposing sides of the spacer block; and means for supporting the lever for rotation in the latch assembly.

2. The latch assembly of claim 1 wherein the recess of the cover means is generally centrally located in a cover member and wherein the cover member and the cover recess are both symmetric with respect to a plane bisecting both the cover member and the cover recess.

3. The latch assembly of claim 2 wherein the spacer block recesses are located generally closer to one of two opposing ends of the spacer block.

4. The latch assembly of claim 3 wherein the spacer block has a central bisecting plane of symmetry.

5. The latch assembly of claim 4 wherein the central bisecting plane of the spacer block is perpendicular to the plane bisecting both the cover member and the cover recess.

6. The latch assembly of claim 5 wherein the lever has a central plane of symmetry, the central plane of the lever bisecting the lever and being parallel to the central plane of the spacer block.

7. The latch assembly of claim 1 further comprising biasing means contacting the lever for biasing the lever to a latching orientation.

8. The latch assembly of claim 7 wherein the biasing means comprises a leaf spring positioned between a portion of the lever and a portion of the spacer block.

9. The latch assembly of claim 1 wherein a second portion of the lever extends through the cover means when the lever is in a latching orientation for locking the lever in the latching orientation.

10. The latch assembly of claim 9 wherein the spacer block further comprises a padlock loop extending through the cover means adjoining the second portion of the lever and oriented for receiving and supporting a member extending across the second portion of the lever for locking the lever in the latching orientation.

11. The latch assembly of claim 1 wherein the lever has a flange at the remote end of the elongated portion for engaging with a latch keeper receiving the elongated portion when the elongated portion is pulled from the keeper in an elongated direction of the elongated portion.

12. The latch assembly of claim 1 wherein the cover means comprises two cover members, one of the cover members having a recess for receiving the spacer block and the lever and the other cover member forming a recess with the one cover member for receiving a portion of a vertical member supporting the latch assembly.

13. The latch assembly of claim 12 wherein the two cover members are adapted to be coupled together around the lever and the spacer block and wherein a plane of symmetry bisects each of the two cover members.

14. The latch assembly of claim 1 wherein the means for supporting the lever comprises a spindle extending through the cover means, the lever and the spacer block along a central plane of symmetry of the cover means.

15. The latch assembly of claim 1 in further combination with a swinging member supporting the latch assembly and a hinge supporting the swinging member for rotation, the hinge including a pair of substantially identical post leaves and a gate leaf rotatable with respect to the post leaves, each post leaf including a planar post plate having a center line therethrough, a knuckle adjoining the center line and supported from the post plate by means of an extension, the post plate being supported by the extension tangentially offset from the knuckle to permit mounting of the hinge on a planar surface supporting the post plates of the pair of post leaves, the gate leaf including at least a pair of spaced knuckles supporting a substantially radially extending support plate adapted for receiving and rotatably supporting the swinging member on the post leaves.

16. The combination of claim 15 further comprising a hinge pin extending axially through the post leaf knuckles and the gate leaf knuckles, a coil spring positioned about one end of the pin, the pin being fixedly coupled to one of the post leaves, one end of the spring being fixedly coupled to the pin and a second end of the spring being movably coupled with the gate leaf for loading and unloading of the spring during movement of the gate leaf with respect to the post leaves.

17. The latch assembly of claim 1 wherein the opposing elongated sides of the spacer block are major sides of the spacer block.

18. The latch assembly of claim 1 further comprising aligned openings in each of the lever, spacer block and cover means; and further comprising fastener means passing through the aligned openings for coupling the lever, spacer block and cover means together.

19. The latch assembly of claim 18 wherein the cover means comprises two, separate cover pieces held together by the fastener means and wherein a gap is provided between adjoining portions of the two separate cover pieces for receiving therebetween a member to support the latch assembly, the cover means being adapted for coupling the latch assembly to the received support member.

20. The latch assembly of claim 1 wherein the spacer block comprises a planar web portion and flange means extending perpendicularly to the planar web portion at opposing ends of the planar web portion and defining on opposing sides of the planar web portion the recesses on each of the opposing sides of the spacer block.

* * * * *